US006115918A

United States Patent [19]

Kent

[11] Patent Number: 6,115,918

[45] Date of Patent: Sep. 12, 2000

[54] HEAT EXCHANGER MANIFOLD SEPARATOR INSTALLATION METHOD

[75] Inventor: Scott Edward Kent, Albion, N.Y.

[73] Assignee: Delphi Technologies, Inc., Troy, Mich.

[21] Appl. No.: 09/328,288

[22] Filed: Jun. 8, 1999

[51] Int. Cl.[7] ..... B21D 53/02

[52] U.S. Cl. ..... 29/890.03; 29/890.052; 165/174.73

[58] Field of Search ..... 29/890.052, 890.03; 165/174, 173

[56] References Cited

U.S. PATENT DOCUMENTS

| | | | |
|---|---|---|---|
| 4,581,818 | 4/1986 | Kondou et al. . | |
| 5,036,914 | 8/1991 | Nishishita et al. | 165/173 |
| 5,062,476 | 11/1991 | Ryan et al. | 165/173 |
| 5,107,926 | 4/1992 | Calleson | 165/173 |
| 5,148,598 | 9/1992 | Gentry . | |
| 5,207,738 | 5/1993 | Dey | 165/173 |
| 5,329,995 | 7/1994 | Dey et al. | 165/153 |
| 5,607,012 | 3/1997 | Buchanan et al. | 165/173 |
| 5,898,996 | 5/1999 | Buchanan et al. | 29/890.052 |

*Primary Examiner*—Irene Cuda
*Assistant Examiner*—Anthony L. Green
*Attorney, Agent, or Firm*—Patrick M. Griffin

[57] ABSTRACT

A manifold tank flow pass separator for a condenser is installed in such a way as to prevent deformation of the manifold tank longitudinal edge when a separator retention groove is formed in the tank inner surface. The inner surface of the tank is thinned or effectively cut away where it borders the tank edges, to create a cross tank, edge to edge width that matches the separator diameter or width. Then, when a tool for forming the retention groove is pushed into the tank inner surface and between the edges, it clears the edges, creating no deformation in the edges, or in the bottom surface.

3 Claims, 6 Drawing Sheets

HEAT EXCHANGER MANIFOLD SEPARATOR INSTALLATION METHOD

TECHNICAL FIELD

This invention relates to automotive heat exchangers, and specifically to a method for installing a flow pass separator and/or tank end plug in a condenser manifold.

BACKGROUND OF THE INVENTION

Modern automotive air conditioning system condensers are generally all aluminum designs, in which aluminum flow tubes, fins and refrigerant inlets and outlets are all brazed together concurrently. Braze cladding material on the outer surface of the various parts melts in a braze oven and is drawn into the various surface to surface interfaces between components to create solid, leak proof joints. In general, braze technology has advanced to the point where, if the edge to edge or edge to surface interfaces between various parts of the manifold can be evenly held, then melted braze material will be drawn evenly and adequately into those interfaces to form solid, leak proof joints. The manufacturing challenge, then, is to hold the interfaces "to print."

One common brazed condenser design is the so called serpentine, in which only one (or two) very long flow tubes wend sinuously back and forth over the entire surface area of the condenser. The one or two tubes have only two open ends each, each of which opens to a small inlet and outlet fixture. The serpentine design presents very few potential external leak points, but is limited as to how closely the various runs of the tube may be spaced, since the tube can not be bent too tightly. The other basic condenser design uses two long, spaced apart manifolds, and a plurality of short, straight tubes, each of which opens through a slot into each of the manifolds. Refrigerant is fed in and out of the tube ends through the common manifolds. While a thinner tube may be used (since it doesn't have to be bent), there are clearly many more potential leak points, two for each tube. Furthermore, most manifolds are two piece designs, formed from two split sections secured together at abutted longitudinal edges. One manifold section is slotted, to admit the ends of the flow tubes, and generally referred to as a header plate, which the other section may be referred to as a manifold tank. The abutted edges represent external seams, which must be sealed against the internal pressure. In addition, each end of the manifold must be plugged with a suitable brazed end cap or plug.

Another issue with two piece manifolds is the use of internal separators/ and or end caps. These are basically the same type of internal structures, being a close fitting plug that is brazed closely within the interior of the manifold, with an outer edge that must make a leak free joint with the inner surfaces that it contacts. Each manifold must have two such structures, one at each end, which are referred to as end caps. In addition, if it is desired to "multi-pass" the condenser, there must be at least one such structure somewhere between the two end caps in at least one manifold. So used, such structures are generally referred to as separators or baffles. If only one is used, in just one tank, with an inlet above and an outlet below, then a two pass flow pattern is created. The addition of a separator in the other tank creates a three pass pattern, and so one. Separators located intermediate the end caps obviously do not present problems of external leaks if they are inadequately brazed, although reduced efficiency results if refrigerant leaks internally past an inadequately brazed separator.

While a poorly brazed internal separator creates no external leaks in and of itself, an only recently recognized problem is the potential effect that a common method of separator installation can have on the longitudinal seam integrity. The problem results from the means used to temporarily, mechanically hold the separator in place between the header and manifold tank before the braze operation is completed. Current designs generally use a pair of aligned recessed "pockets" or retention grooves in the manifold tank and the header plate, within which the edge of the separator sits and is held. When the header plate is clinched to the tank, the separator is securely sandwiched and held in place between the aligned grooves. An example may be seen in U.S. Pat. No. 5,329,995, where the inner surfaces of the header and manifold tank (and the retention grooves) have differing diameters, requiring that the separator have a "notched" shape to match. U.S. Pat. No. 5,607,012 improves upon that design by forming the two grooves on a common diameter, thereby allowing the separator to be a simple circular disk, with no preferred orientation.

A recent improvement of the round separator design referred to above has eliminated one of the pockets or retention grooves entirely, leaving only the groove in the manifold tank. The inner surface of the header plate, rather than being grooved, is final formed with an accurate cylindrical surface, so as to closely match the outer edge of the separator, with a close tolerance interface. At installation, the manifold tank is oriented to open upwardly, and the separator/end caps are set into the retention grooves, which hold them in place. Next, the header plate edges are abutted to the manifold tank edges, and the two are clinched together. If the header plate and the manifold tank are both formed accurately and to print, then the cylindrical inner surface of the header plate and the bottom surface of the manifold tank will lie on a common circle. That common circle, in turn, will make a close controlled interface, all the way round, with the circular (annular) perimeter edge of the separator, so that a good braze joint will form. In addition, the longitudinal edges of the header plate and manifold tank will make close, accurate contact all along their length, to form an accurate interface and braze seam.

The only recently recognized problem referred to above is the effect that the method of forming the retention groove in the manifold tank (or in the header plate, in cases where there is one) has on the longitudinal edge. As can be seen in FIG. 1, the concave (semi cylindrical) inner surface of the manifold tank 10 is initially smooth, and extends for approximately 180 degrees up to a pair of spaced longitudinal edges 12, which are approximately 0.12 inch wide. Standing up from the edges 12 is a pair of crimp flanges 14. Separator 16 is a simple circular disk, with an outer edge 18 of pre determined diameter D, which is about 0.74 inch the embodiment disclosed, as well as approximately 0.08 inch thick. The circular outer edge 18 represents a nominal perimeter that the separator 16 would ideally occupy within tank 10, as indicated by the dotted line in FIG. 2. The radius of the majority of the inner surface of tank 10 is approximately 20 thousandths of an inch less than separator edge 18. As it approaches the longitudinal edges 12, however, the inner surface departs radially inwardly from it's majority radius to create a narrowed trough of width W, which is about 0.64 inch, as measured between the edges 12. In effect, the tank edges 12 are widened as the space between them is narrowed.

Referring next to FIGS. 2 through 4, a coining punch 20 has a semi circular working edge 22 with a diameter and thickness substantially equal to the separator edge of separator 16. The radius of edge 22 is actually very slightly larger than separator edge 18, approximately two thousandths of an inch greater, in order to create an ideal radial brazing clearance of the same size. Tank 10 is supported in the upward opening orientation shown and punch 20 is moved forcefully in a direction normal to, and centrally between, the edges 12, at each location where a separator/end cap 16 is to be installed. This would be at least near each end of each tank 10, to plug the ends, and anywhere else where a flow division point was needed. Ultimately, the punch 20 is stopped when its working edge 22 reaches the nominal perimeter represented by the dotted line in FIG. 2. Since its diameter is greater than the inner surface of tank 10, the punch edge 22 is forced into the inner surface of tank 10, displacing material radially outwardly, which appears in a matching annular bulge (not illustrated) in the outside of tank 10. On the inside, the punch edge 22 creates a shallow retention groove 24 with a depth of approximately twenty thousandths of an inch, over most of it the inner surface of tank 10. Where it approaches and opens through the side edges 12, however, the groove 24 is significantly deeper, as much as fifty thousandths of an inch, because of the D-W differential described above. Ideally, the bottom of groove 24, regardless of its depth, would reside substantially on the circular nominal perimeter shown in dotted line in FIG. 2, larger in radius only by the ideal radial brazing clearance described above. Another effect of the W-D differential prevents that ideal result, however.

Referring next to FIGS. 4 and 5, the D-W differential causes the tool working edge 22 to drag past the inner corners of the tank edges 12 with more interference than along the rest of the tank inner surface, acting to pull and draw surface metal down and toward the bottom of the tank 10. As a consequence, a localized deformation occurs both in the bottom surface of groove 24, where it opens through the side edges 12, and in the side edges 12 proximate to that opening. Specifically, the bottom of groove 24 slopes out and away from the ideal circle, potentially all the way across the width of edges 12. Also, the ideally flat surfaces of the edges 12 curve down into the groove 24.

Referring next to FIGS. 5 through 7, separator 16 is installed by dropping it into retention groove 24, and then installing a header plate 26. Header plate 26, as described above, is generally a semi-cylinder, with an accurately finished inner surface 28 having a radius substantially equal to (or only 2–4 thousandths greater than) the separator edge 18, and flat longitudinal edges 30 with a thickness of approximately seventy thousandths inch. Header plate 26 is inserted between the crimp flanges 14 until the respective pairs of edges 12 and 30 abut. The flanges 14 are then bent inwardly over the outside of header plate 26. The separator outer edge 18 is closely captured between the header plate inner surface 28 and the bottom of groove 24. However, shown by the dotted line in FIG. 7, the interface gap around the separator outer edge 18 widens from the ideal in the areas near the tank edges 12. In addition, there is a gap in the otherwise close abutment between the edge pairs 12 and 30 in the same area. When the tolerance stack ups are such as to create the worst interference condition (W at the narrowest end of the tolerance range, D at the smallest, the tool working edge 22 at its largest), these gaps can potentially allow an external leak past the seam between the edges 12 and 30, or an internal by pass leak around the separator edge 18, or both. These can be detected through proper post-braze testing, and either fixed or discarded, and routinely are. Still, it would be preferable to prevent such potential leaks, if possible.

SUMMARY OF THE INVENTION

The invention provides an improved manifold tank design, which, in turn, improves the separator installation method described above.

In the preferred embodiment installed, the same basic separator, header plate, and coining punch are used, as well as the same basic manufacturing and processing steps. The cross sectional profile of the tank is modified, however. The inner surface of the tank is thinned, over a narrow strip along each tank edge, so as to lie substantially on the nominal perimeter of the separator outer edge. As a consequence, when the coining punch edge enters the inside of the tank, it has little or no interference with the side edges of the tank, and does not locally deform them. The recessed retention groove subtends less of an arc, and ends short of the tank side edges. Still, the groove created is more than sufficient to hold the separator temporarily in position as the header plate is crimped in place. In addition, the reduction in punch edge interference leaves the bottom of the separator retention groove that is formed thereby closer to the ideal, nominal separator outer edge perimeter. Consequently, the radial interface surrounding the outer edge of the separator, and the long seam between the abutted longitudinal edges of the tank and header plate, are more nearly constant, and the braze seams that form therein are complete.

DESCRIPTION OF THE PREFERRED EMBODIMENT

Figure 1:
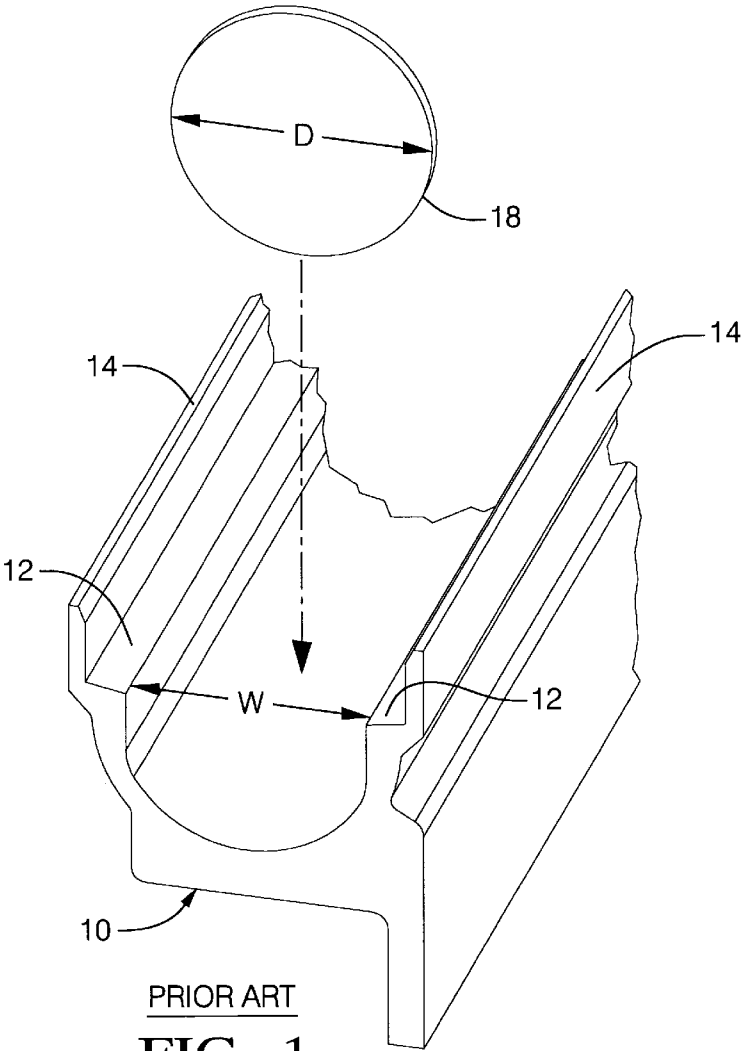
PRIOR ART FIG. 1
FIG. 1 is a perspective view of the inner surface of one end of the prior art manifold tank design described above, showing a separator above.
Figure 2:
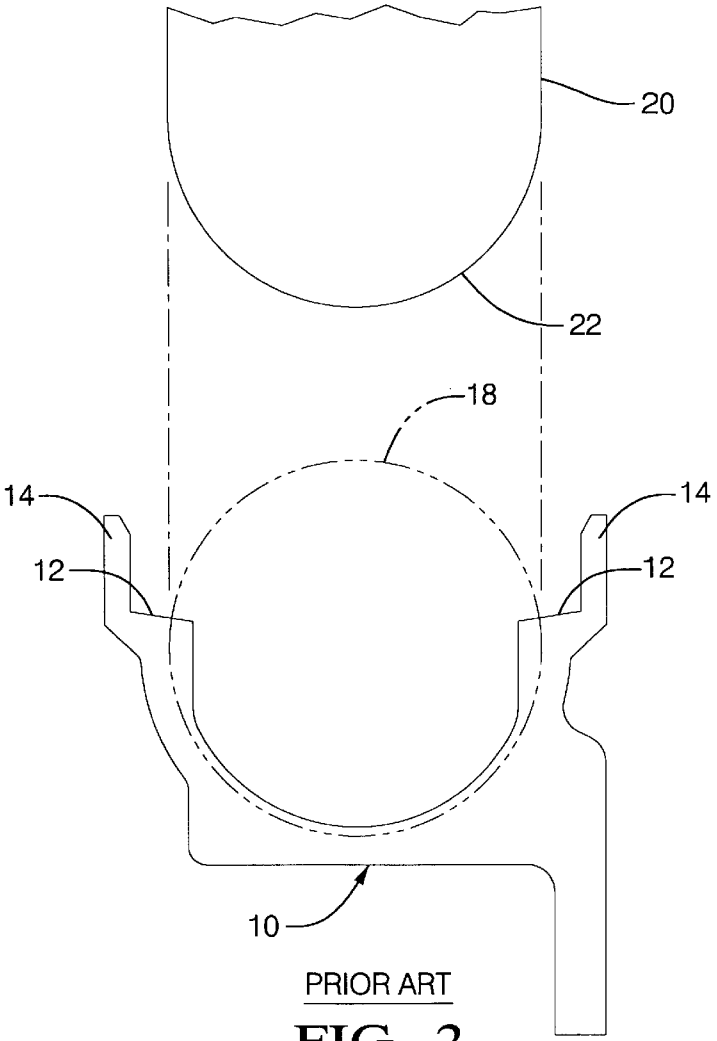
PRIOR ART FIG. 2
FIG. 2 is an end or cross sectional view of the tank, showing the coining punch above.
Figure 4:
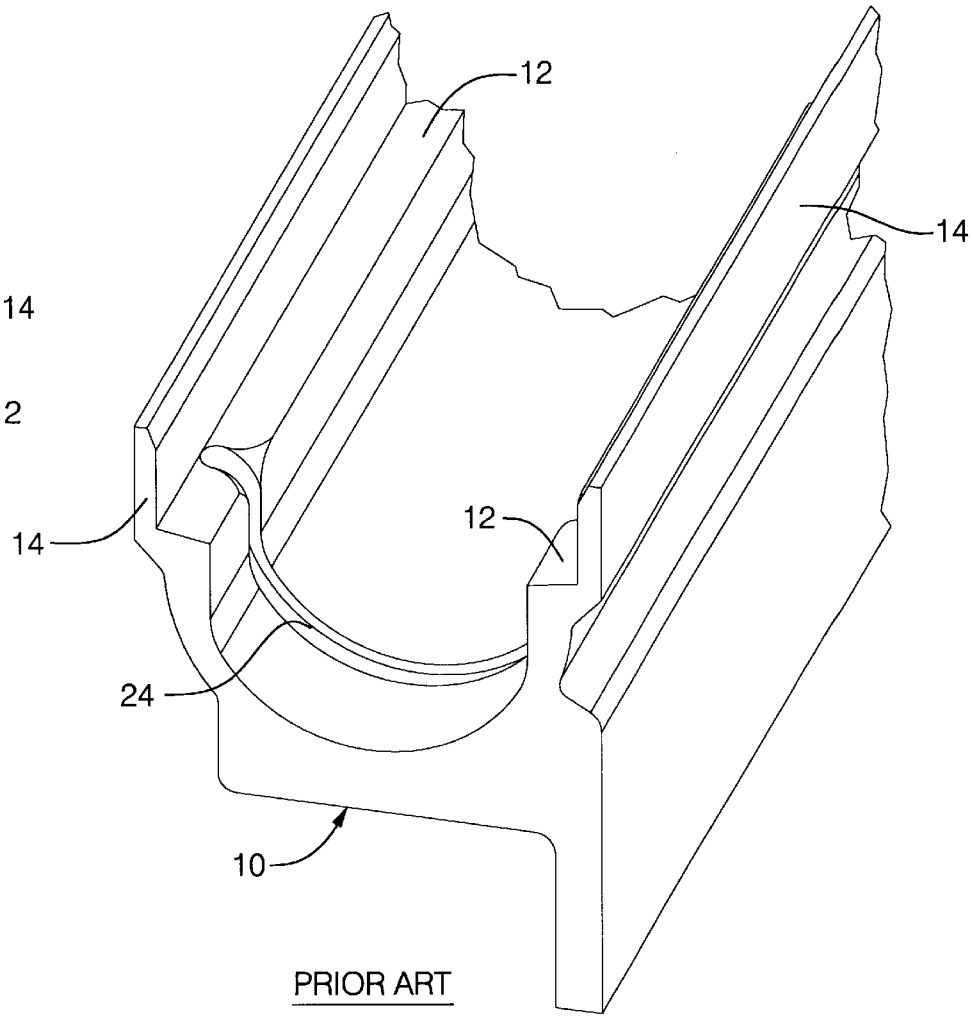
PRIOR ART FIG. 4
FIG. 4 is a perspective view of the retention groove formed.
Figure 3:
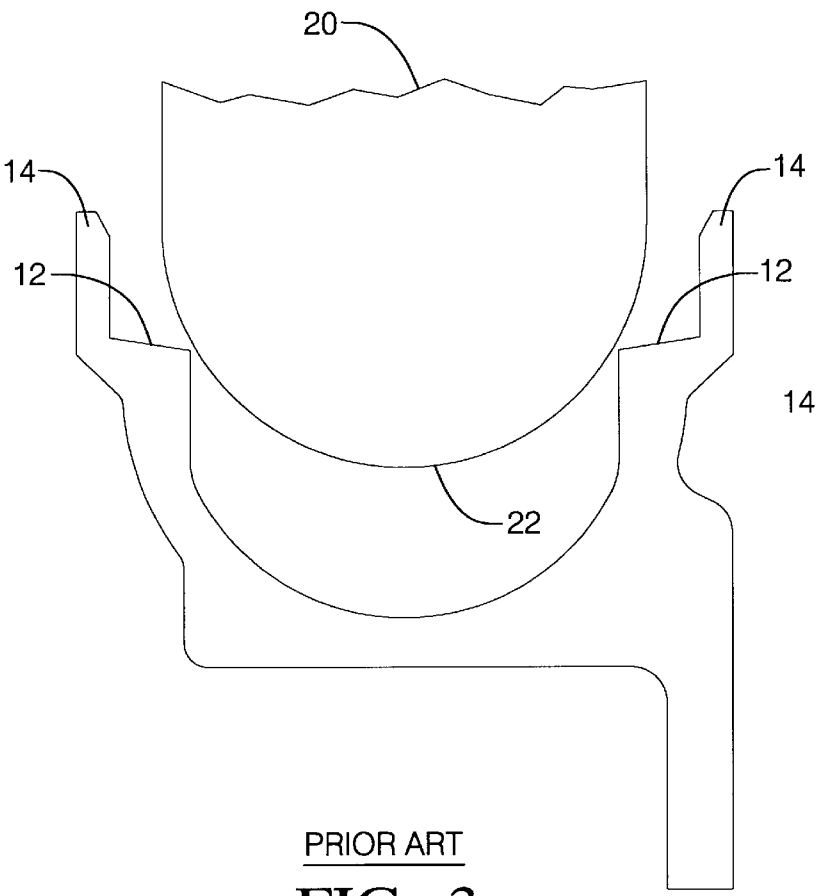
PRIOR ART FIG. 3
FIG. 3 shows the coining punch in the process of being pushed down into the tank inner surface.
Figure 7:
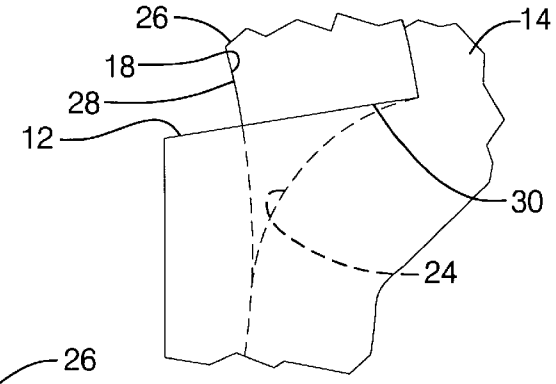
PRIOR ART FIG. 7
FIG. 7 is an enlargement of the circled area of FIG. 6, showing the intersection of the interface around the separator outer edge and the tank to header plate seam.
Figure 6:
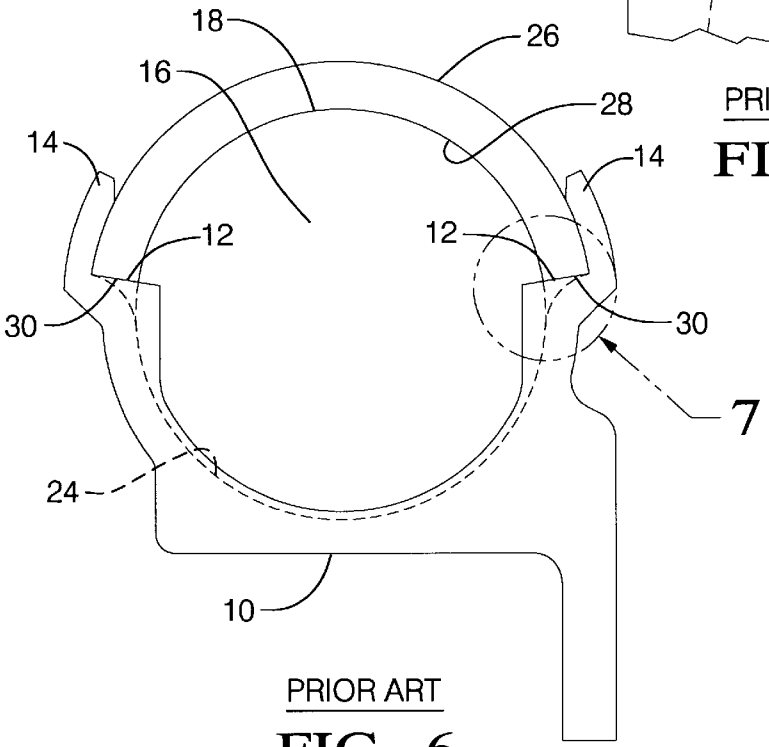
PRIOR ART FIG. 6
FIG. 6 shows the tank and header plate of FIG. 5 crimped together, with the separator in place.
Figure 5:
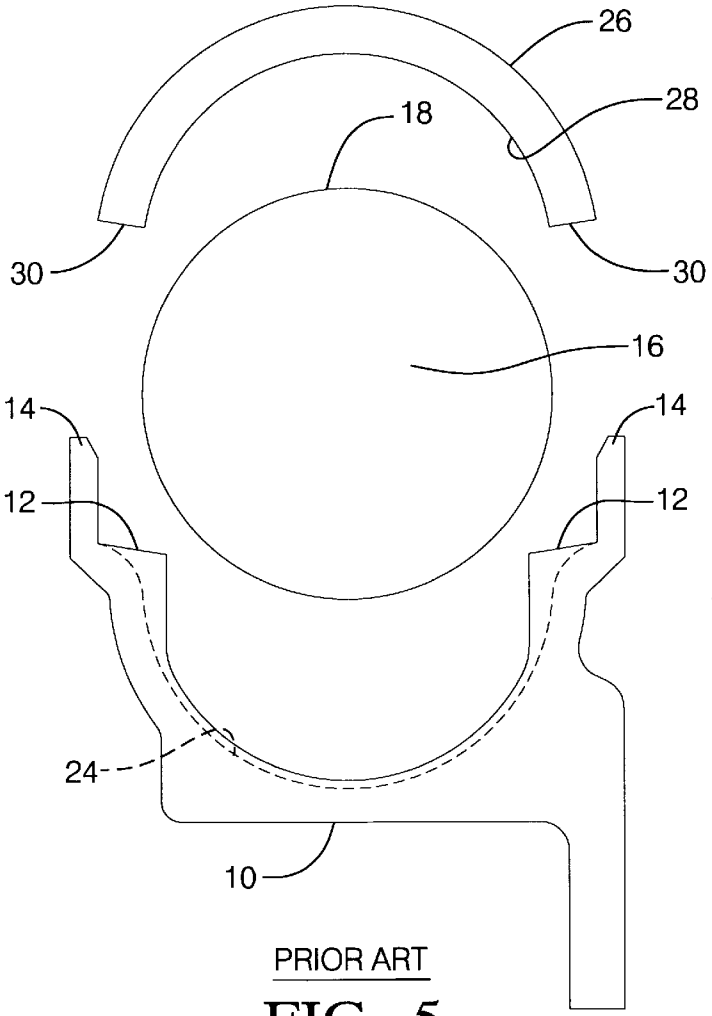
PRIOR ART FIG. 5
FIG. 5 shows and end view of the grooved tank, separator and head plate aligned, prior to installation.
Figures 8, 9, 10:
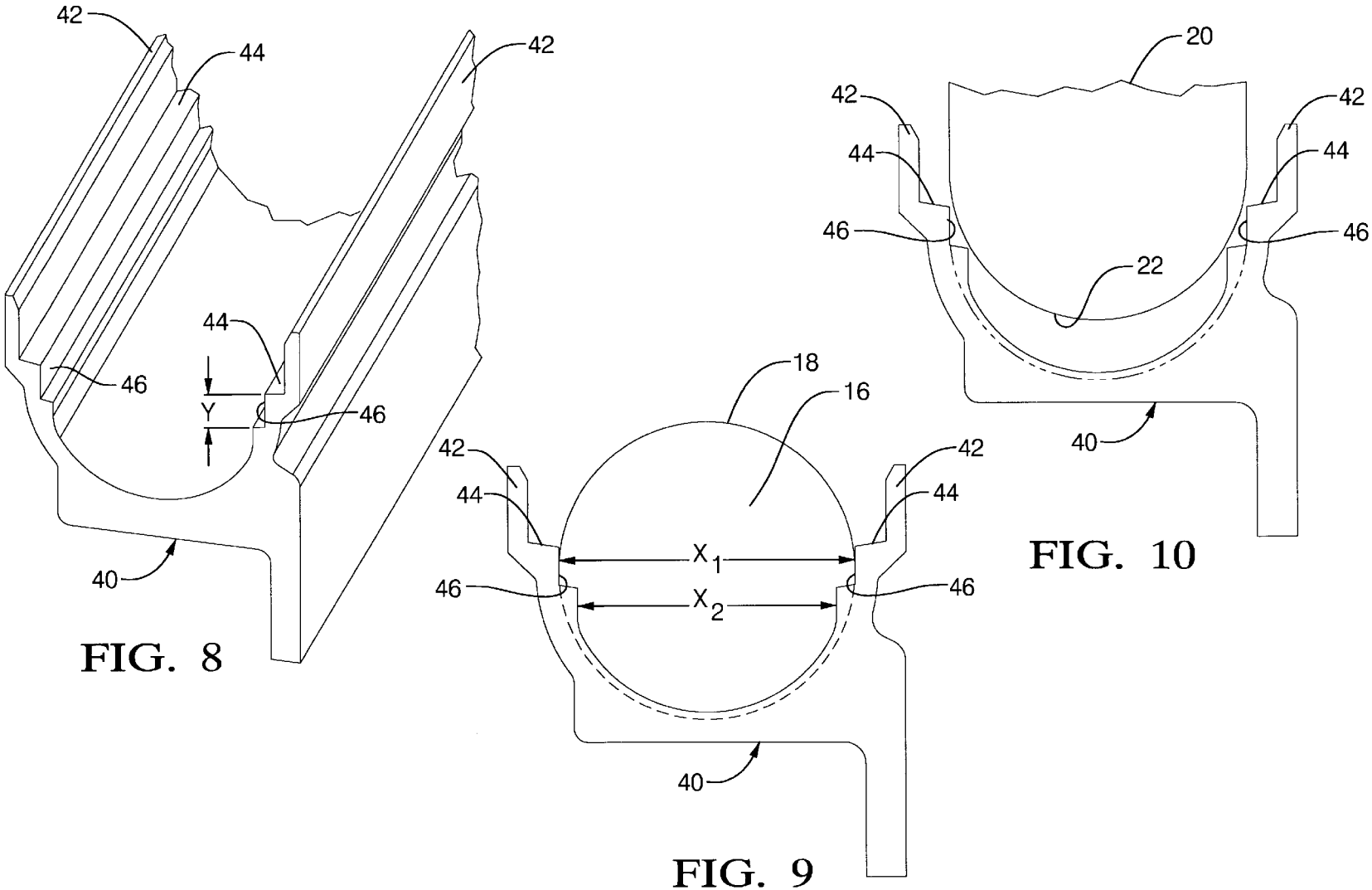
FIG. 8 is a perspective view of the inner surface of one end of a manifold tank made according to a preferred embodiment of the invention.
FIG. 9 is an end or cross sectional view of the tank of FIG. 8, showing the nominal perimeter of the separator outer edge in dotted line.
FIG. 10 shows the same coining punch in the process of being pushed down into the tank modified according to the invention.

Referring first to FIGS. 8 and 9, a modified tank according to the invention is indicated generally at 40. Basically, tank 40 is identical to tank 10, apart from one major, but easily manufactured, modification. Tank 40 is also a one piece aluminum extrusion, with a semi cylindrical surface that also has the same radius as tank 10 over most its extent, crimp flanges 42 equivalent to crimp flanges 14, and the same length longitudinal edges 44 as edges 12. The edges 44, however, are narrower, with an inner separation X1 that is substantially equal to the separator diameter D, or only very slightly larger. This is achieved by providing an extruded tank profile or cross section that has a thinner inner surface area 46 bordering each edge 44. The thinned strip 46 is designed so that its inner surface coincides with the nominal perimeter of the same separator 16, which is shown by dotted line in FIG. 9, with a width Y of approximately eighty thousandths of an inch. As a consequence, the edges 44 are narrower than the edges 12, only as wide as necessary to abut the header plate edges 30. The inner surface of tank 40 still departs radially inwardly slightly of the nominal perimeter as it approaches the thinned strips 46, leaving a least width X2 of approximatley 0.64 inch, which is narrower than the diameter of the separator edge 18, but still significantly wider than W. The strip 46 is easily provided, simply by modifying the profile of the extrusion die through which the aluminum billet is forced. The resulting tank 40 is not appreciably weaker, and is actually somewhat lighter, as compared to tank 10.

Figure 12:
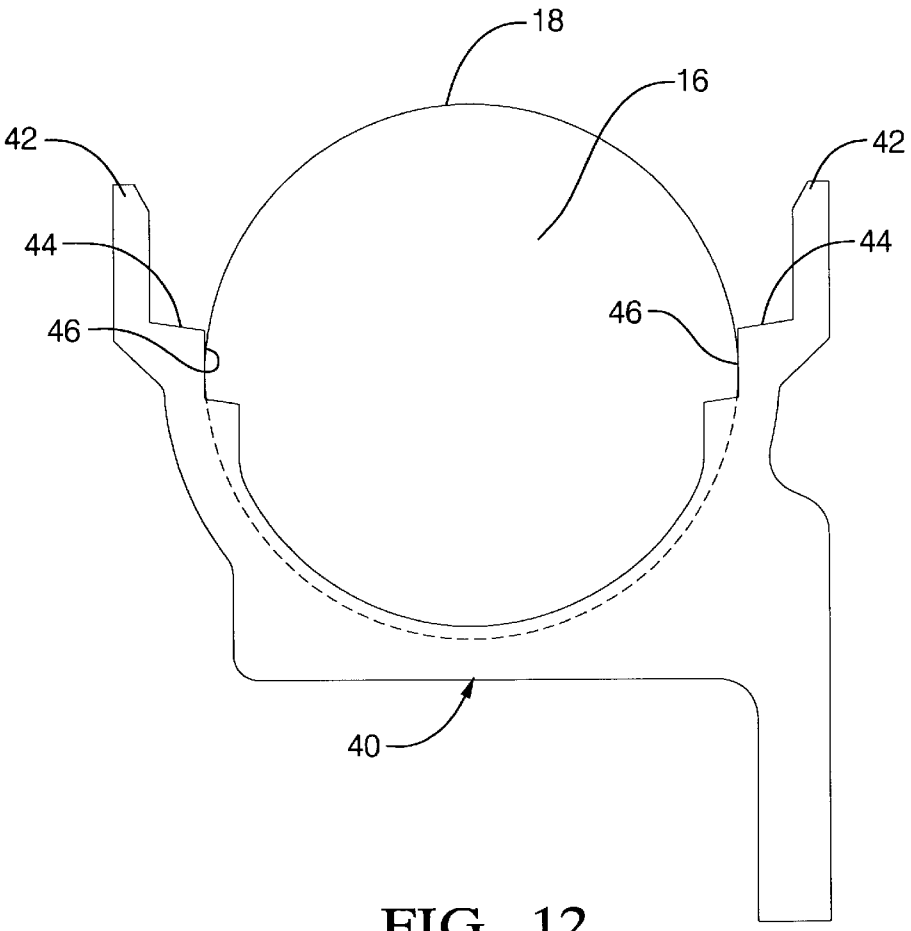
FIG. 12 is an end view of the modified tank with a separator set into the retention groove.
Figure 11:
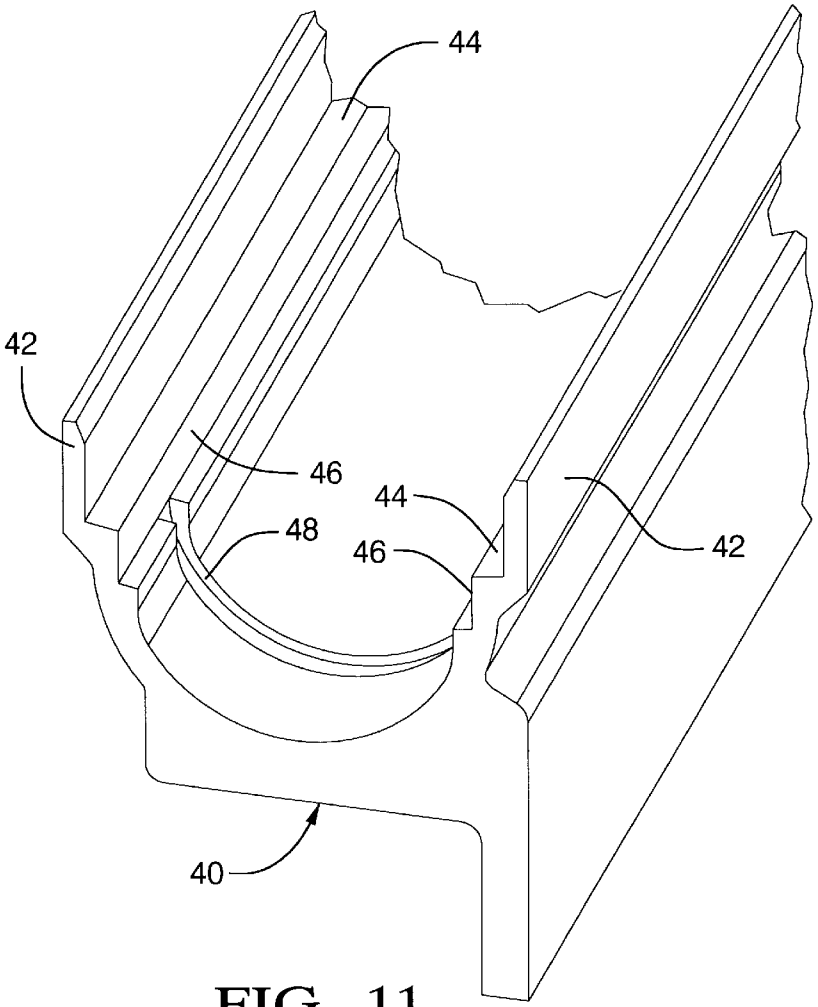
FIG. 11 is a perspective view of the improved retention groove formed in the modified tank.

Referring next to FIGS. 10 through 12, the same coining punch 20 is used for tank 40, with the same size working edge 22, and it is applied in the same fashion. Now, however, there is essentially no interference between the working edge 22 and the narrower longitudinal edges 44. Instead, since X1 is substantially equal to diameter of the separator edge 18, the equivalent diameter tool edge 22 passes freely by and between the thinner strips 46, and does not begin to force surface metal down until it reaches the thicker inner surface area below (relatively thicker than the area 46, though not thicker than found in tank 10) Since the thicker inner surface portion of tank 40 has substantially the same radial differential relative to edge 22 as the inner surface of tank 10, an equivalent depth retention groove 48 is formed. Groove 48, while it subtends less arc end to end than groove 24, has the same basic depth over most of its length. As is best seen in FIG. 11, the lack of interference with the edges 42 leaves them flat and undisturbed. There is, of course, some deliberate interference between the punch working edge 22 and the rest of the inner surface of tank, 40 without which no groove 48 would result. That interference is greatest at the narrower width X2, creating a deeper pocket 48 at those two points, with more metal displaced. Still, however, the fact that the thinned strips 46 remove the points where the punch interference begins substantially away from edges 44 means that no deformation is created in the flatness of the edges 44 by the action of the punch edge 22. Furthermore, the fact that the X2-D differential is less than the W-D differential means that the bottom of groove 48 is not deformed away from the nominal circular perimeter of separator edge 18 at the ends of groove 48.

Figure 13:
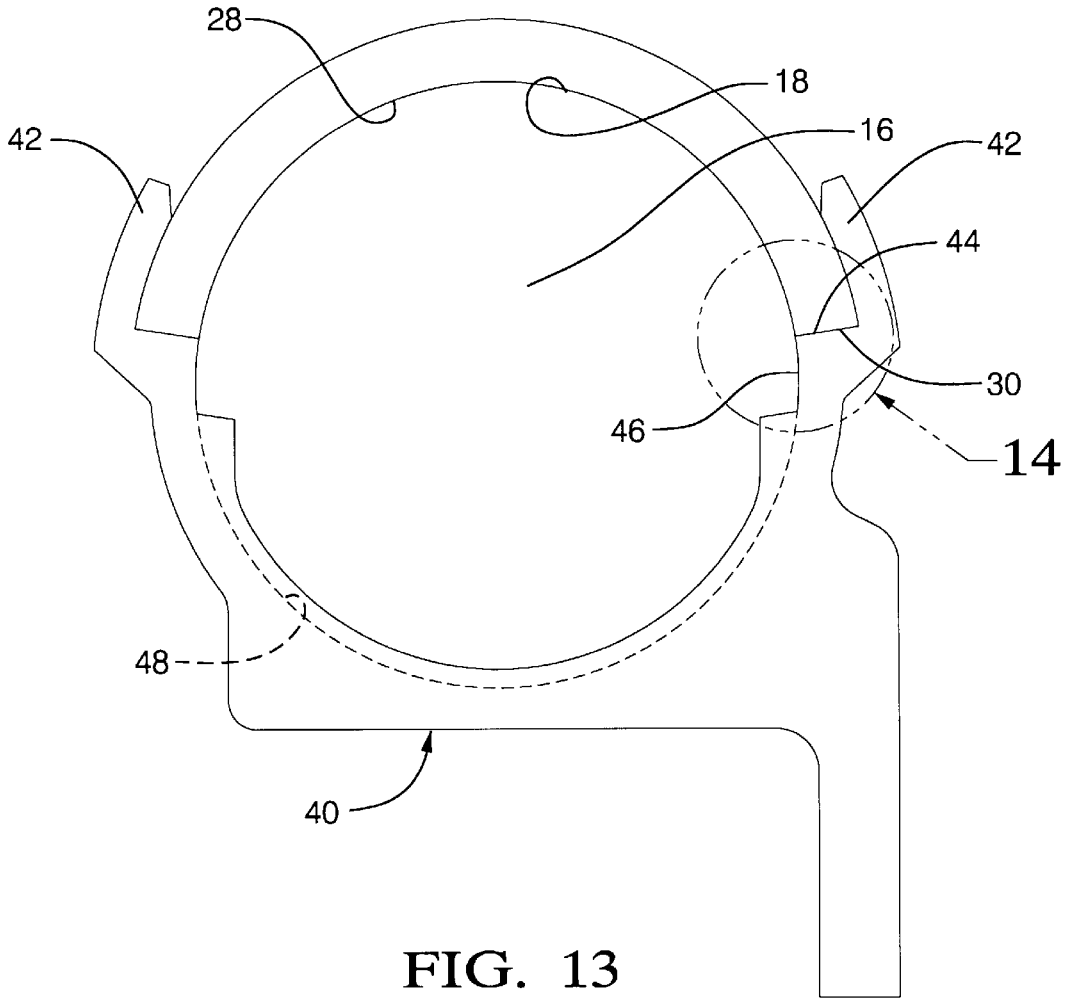
FIG. 13 shows the header plate crimped onto the modified manifold tank.
Figure 14:
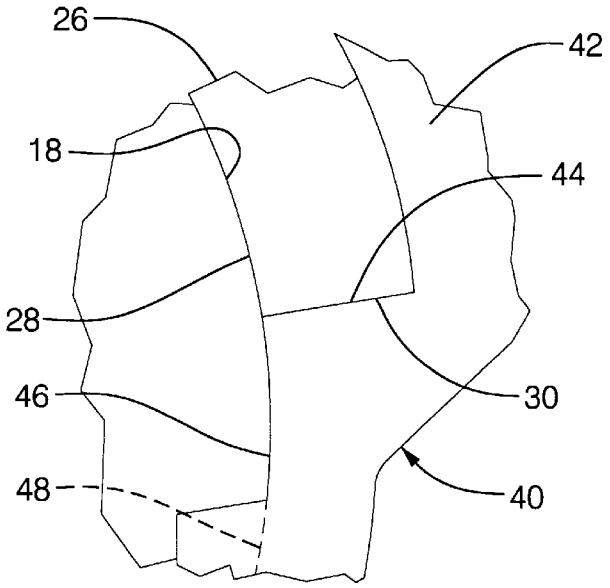
FIG. 14 is an enlargement of the circled area of FIG. 13, showing intersection of the interface around the separator outer edge and the tank to header plate seam.

Referring next to FIGS. 13 and 14, the same separator 16 is installed in the groove 48, which provides sufficient support to hold in place temporarily, despite being shorter end to end and being less deep at the ends than groove 24. Next, the same header plate 26 is crimped on. Because of the lack of deformation caused by the punch 20, the abutted tank edges 44 and header plate edges 30 have no gap between them. Because the bottom of groove 48 lies more accurately concentric to the nominal perimeter of separator outer edge 18, the interface surrounding it is regular and even, as best seen in FIG. 14. The braze joints formed at these interfaces are therefore solid and complete, with far less potential for either external or internal leaks. In conclusion, only a change in the extrusion die, to produce a tank with the modified profile shown, is needed. All other parts and installation tools and steps remain the same.

Variations in the preferred embodiment disclosed could be made. Most generally, the method can be applied in any case where a concave manifold tank and header plate of any cross sectional shape or profile are secured together with abutted longitudinal edges that form external seams, and where an internal separator pocket is formed into the inner surface of one or both of the inner surfaces of tank or plate. By providing a surface profile in which the thicker, pocket forming surface area terminates short of the side edges, so that the retention groove forming tool does not disturb the side edges, better conformation of all interface forming surfaces is obtained. In addition, by forming a retention groove only in the manifold tank, and not the header plate as well, the necessity of aligning pairs of retention grooves with each separator is eliminated, and the possibility of skewing the separator edge between mismatched groove pairs is eliminated. The thicker inner surface area could be formed with a constant radius, one which was concentric to the separator edge over its entire length, rather than diverging inwardly as it approached the thinner area 46. This would reduce the pocket's depth and retention force at the corners, as compared to the embodiment disclosed, but would still work if the separators were carefully dropped in place prior to the header plate being added.

What is claimed is:

1. A method of installing a separator between a mating pair of concave heat exchanger manifold sections, each of which has a pair of straight longitudinal edges that are abutted and secured together to create a pair of external seams, with the separator oriented generally perpendicular to said seams and with the outer edge of said separator lying on a predetermined nominal perimeter within the interior space enclosed by said manifold sections, said method comprising the steps of, providing one of said manifold tank and header plate with a thicker inner surface area that extends radially inboard of said separator edge nominal perimeter, but which terminates circumferentially short of said longitudinal edges, providing said one manifold sections with a thinner inner surface area extending from the termination of said thicker area to its longitudinal edges, and which lies substantially on said separator edge nominal perimeter, forcibly impressing a concave separator edge retention groove into said one manifold section inner surface, in a direction substantially perpendicular to said longitudinal edges, with a tool having a working edge that lies substantially on said separator edge nominal line, and which therefore affects the manifold section inner surface in said thickened area only, without affecting said longitudinal edges, orienting said one manifold section so that its concave inner surface opens upwardly, placing said separator in said retention groove, and, abutting said manifold section longitudinal edges and securing them together to form said seams, whereby said pairs of longitudinal edges abut fully and completely, without a gap in the area proximate to said separator retention grooves.

2. A method of installing a separator between a concave heat exchanger manifold tank and a concave header plate, in which the tank and header plate have pairs of straight longitudinal edges that are abutted and secured together to create a pair of external seams, with the separator oriented generally perpendicular to said seams and with the outer edge of said separator lying on a predetermined nominal perimeter within the interior space enclosed by said tank and header plate, said method comprising the steps of, providing the concave header plate with an inner surface that lies substantially on said separator outer edge nominal perimeter, providing the concave manifold tank with a thickened inner surface area that extends radially inboard of said separator edge nominal perimeter, but which terminates circumferentially short of said manifold tank longitudinal edges, providing said concave manifold tank with a thinner inner surface area extending from the termination of said thickened area to its longitudinal edges, and which lies substantially on said separator edge nominal perimeter, forcibly impressing a concave separator edge retention groove into said manifold tank, in a direction substantially perpendicular to said longitudinal edges, with a tool having a working edge that lies substantially on said separator edge nominal line, and which therefore affects the tank inner surface in said thickened area only, without affecting said manifold tank longitudinal edges, orienting said manifold tank so that its concave inner surface opens upwardly, placing said separator in said retention groove, and, abutting said manifold tank and header plate longitudinal edges and securing them together to form said seams, whereby said pairs of longitudinal edges abut fully and completely, without a gap in the area proximate said separator retention grooves.

3. A method of installing a circular separator between a semi cylindrical heat exchanger manifold tank and a semi cylindrical header plate, in which the tank and header plate have pairs of straight longitudinal edges that are abutted and secured together to create a pair of external seams, with the separator oriented generally perpendicular to said seams and with the outer edge of said separator lying on a predetermined nominal perimeter within the interior space enclosed by said tank and header plate, said method comprising the steps of, providing the header plate with an inner surface that has a radius substantially equal to said separator outer edge, providing the concave manifold tank with a thickened inner surface area has that extends radially inboard of said separator edge nominal perimeter, but which terminates circumferentially short of said manifold tank longitudinal edges, providing said concave manifold tank with a thinner inner surface area extending from the termination of said thickened area to its longitudinal edges, and which lies substantially on said separator edge nominal perimeter, forcibly impressing a concave separator edge retention groove into said manifold tank, in a direction substantially perpendicular to said longitudinal edges, with a tool having a working edge with a radius substantially equal to said separator edge, and which therefore affects the tank inner surface in said thickened area only, without affecting said manifold tank longitudinal edges, orienting said manifold tank so that its inner surface opens upwardly, placing said separator in said retention groove, and, abutting said manifold tank and header plate longitudinal edges and securing them together to form said seams, whereby said pairs of longitudinal edges abut fully and completely, without a gap in the area proximate said separator retention grooves.

* * * * *